United States Patent [19]

Boyd et al.

[11] Patent Number: 4,917,258

[45] Date of Patent: Apr. 17, 1990

[54] SNAP-ON LID FOR OPENED SOFT DRINK CANS

[76] Inventors: James B. Boyd, B. O. S. Enterprise, Rte. 6, Box 6052, Hermiston, Oreg. 97838; September Flick; Otto A. Stein, both of 255 Coggins Dr., D-3, Pleasant Hill, Calif. 94523

[21] Appl. No.: 279,344

[22] Filed: Dec. 1, 1988

[51] Int. Cl.[4] ..... B65D 53/00

[52] U.S. Cl. ..... 220/240; 220/212; 220/258; 220/306; 206/515

[58] Field of Search ..... 220/90.2, 90.4, 258, 220/306, 240, 212; 215/228

[56] References Cited

U.S. PATENT DOCUMENTS

| | | | |
|---|---|---|---|
| 4,162,023 | 7/1979 | Faltermeier | 220/258 |
| 4,165,020 | 8/1979 | Hoselton | 220/306 |
| 4,210,258 | 7/1980 | von Holdt | 220/306 |
| 4,376,493 | 3/1983 | Gall | 220/306 X |
| 4,378,895 | 4/1983 | Woinarski | 220/306 |
| 4,580,692 | 4/1986 | La Barge et al. | 220/240 |
| 4,632,271 | 12/1986 | Taylor et al. | 220/258 |
| 4,693,410 | 9/1987 | Selz | 220/306 X |
| 4,749,100 | 6/1988 | Eberhart | 220/306 |

FOREIGN PATENT DOCUMENTS

| | | | |
|---|---|---|---|
| 0467202 | 2/1969 | Switzerland | 220/258 |
| 2041893 | 9/1980 | United Kingdom | 220/258 |

*Primary Examiner*—Stephen Marcus
*Assistant Examiner*—Nova Stucker
*Attorney, Agent, or Firm*—Chernoff, Vilhauer, McClung & Stenzel

[57] ABSTRACT

A snap-on lid for covering opened beverage cans securely enough to contain effervescent gases effectively during storage of the beverages in such a container, including a collar defining a groove which is downwardly open to receive an upwardly-directed edge of the container. A convex dome is located within the area circumscribed by the collar, and a flexible annular portion surrounds the dome portion of the lid and interconnects it with the collar. A skirt depends from the outer side of the collar portion and fits sealingly against the outer surfaces of the container. An upper margin of the skirt has an inner diameter smaller than that of the outer wall of the collar, presenting an inwardly-directed lip along the open edge of the groove defined by the collar, to engage the bottom of a bead defined at the top of the container and thus aid in retaining the lid in place on the container. A flat, low, tubular opener extends radially out from the skirt of the lid, in one embodiment of the invention, and has an opening for receiving and manipulating an opening lever of an easy-opening beverage can. The lid may be molded of resilient plastics material.

20 Claims, 2 Drawing Sheets

SNAP-ON LID FOR OPENED SOFT DRINK CANS

BACKGROUND OF THE INVENTION

The present invention relates to removable lids for containers, and particularly to a lid for reclosing opened containers of carbonated beverages and the like.

Many beverages contain amounts of dissolved gases, principally carbon dioxide, which must be kept in solution by confining the gas together with the liquid and maintaining a certain amount of pressure on the beverage during its storage in such containers. Generally speaking, when temperature of a beverage increases at a constant pressure the solubility of gas in the liquid decreases, and the tendency of the dissolved gas to escape from the liquid increases correspondingly. On the other hand, if pressure of the gas is increased, solubility of the gas increases.

Much of the appeal of carbonated and other "sparkling" beverages is because of the presence of dissolved gases providing an effervescence which is pleasant, both visually and to the taste. However, once a container of such a beverage is opened, pressure is reduced and the temperature of the beverage is likely to increase. If the dissolved gases are free to evaporate and become separated from the beverage, the effervescence is lost and the beverage becomes "flat," losing its appeal and palatability. It is important, therefore, to provide a tight lid to cover a container for storing such a beverage in order to maintain pressure of the gas on the beverage, yet it is impractical to pour such a beverage from an ordinary opened beverage can into a different container provided with a screw-on top or the equivalent, because the mechanical agitation caused by pouring also causes the dissolved gases to escape from the solution.

Carbonated beverages, beer, ale, and many other drinks are now widely sold in thin-walled cans made of aluminum, with a sheet metal top which usually includes an easily operated can-opening device, usually including an easy-opener lever or pull tab riveted to the top, so that lifting the free end of the lever breaks free and depresses a weakly connected portion of the top, to create an opening. The opener lever, however, is close to the top surface, and not particularly easy to grasp to open the can.

The top is attached to the upper edge of the sidewall of such cans along a top rim including a crimped bead which physically connects the top to the sidewall with a gas-tight seal strong enough to contain the beverage and prevent the dissolved gases from escaping. Once such an easy-opening beverage can has been opened, however, the top of the can must be covered tightly to preserve pressure or the beverage will lose its effervescence within a few hours.

Molded plastic lids have for some time been available for the purpose of covering beverage cans. Such previously available beverage can lids include a generally flat circular top member and depending cylindrical sidewalls which fit snugly and elastically over and around the opened top of an ordinary beverage can. Some such covers have a series of cylindrical walls of increasing diameter interconnected by annular flat portions so that a single cover is useful with beverage cans having any of three different diameters, for example. Such lids, however, are not particularly effective in sealing a beverage can tightly enough to preserve effervescence by retaining dissolved gases in solution within a beverage. Such previously available beverage can lids either have permitted leakage of gas and failed to hold sufficient pressure to preserve the effervescence of the beverage, or else have been forced entirely off the top of the beverage can as a result of the pressure within becoming too great.

What is needed, then, is an improved lid for sealingly covering beverage cans, particularly cans containing carbonated and other effervescent beverages, in order to preserve the dissolved gas content of such beverages after the container has once been opened. It would also be advantageous if the lid included a device for gripping the opener lever portion of an easy-opening can.

Most beverage cans are manufactured to be easily stackable, and aluminum beverage cans, in particular, are commonly manufactured with a concave bottom and a bottom rim which is of smaller diameter than the diameter of the main body of the container, so that the bottom rim of such a can fits snugly within the top rim of a like can, facilitating stacking of such cans with a relatively small likelihood of top cans being displaced accidentally from atop lower cans. The previously available plastic lids for use on beverage cans, because of their generally flat top member, defeat the possibility of an upper can being nested within the rim of a bottom can, making it more likely that a can stacked upon a can covered by such a previously available lid can easily be dislodged and spilled.

What is further desired, then, is an improved lid for a beverage can which preserves the ability to stack similar cans atop a can covered by such a lid.

Although a lid for a beverage container needs to be secure enough to maintain the effervescent qualities of the beverage, it also needs to be removable without undue difficulty. Therefore, an improved lid for opened beverage cans must also provide for such removability.

SUMMARY OF THE PRESENT INVENTION

The present invention supplies an answer to the need for an improved soft drink can lid capable of closing an opened beverage can sealingly, and overcomes the aforementioned shortcomings of previously available lids for closure of opened cans of effervescent beverages.

In accordance with the present invention a lid of resilient, elastic molded plastic is provided in a size adapted to fit a particular type of beverage container, for example, an aluminum soft drink can of 12-ounce capacity, to seal such a container after it has once been opened, and to maintain a gas-tight seal, despite normal pressure changes to be expected within a full or partially full beverage container under the conditions to which it is expected that such a container will be subjected.

One embodiment of the lid according to the present invention includes an upwardly convex dome surrounded by an annular area which interconnects the periphery of the dome with an outer collar portion. The collar defines a downwardly-open groove to receive the bead which connects the top to the aluminum sidewall of such a beverage container and to grip the bead tightly by elasticity of the lid, at least from the outer side of the bead, and preferably from both its inner and outer sides.

A frusto-conical skirt depends downwardly and outwardly beneath the collar, defining a lip at the upper margin of the skirt. The lip extends radially inwardly, into the opening of the groove, to fit beneath the bead connecting the top to the sides of the beverage container, while the skirt fits snugly against the surface of the can sidewall beneath the bead.

The annular area of the lid, between the dome and the collar, is preferably somewhat more flexible than the dome, so that downward pressure on the dome during installation of the lid, while the collar is pressed downward until the groove engages the bead of the can, results in installation of the lid without generating additional pressure within the container. Thereafter, increased pressure within the container, which might result from reduced solubility of the gases as the beverage is warmed or agitated while covered, is accommodated by a lid embodying the invention as a result of the freedom of the dome to rise as the flexible annular area flexes. Such flexure of the annular area tends to raise the inner side of the groove of the collar and simultaneously roll the collar radially outward. This presses the outer side of the collar and the lip of the upper margin of the skirt more tightly against the outer surfaces of the frusto-conical tapered upper part of the sidewall and the bottom of the bead at the top of the sidewall of the beverage can.

In a preferred embodiment, the shape of the dome and the presence of the annular area between the dome and the collar promote stacking of such beverage cans. The dome can extend upwardly into the cavity defined by the bottom of such a beverage can, while the bottom rim of the beverage can is still able to extend downward slightly, within the collar portion of a lid embodying the invention in place atop a can.

It is therefore a principal object of the present invention to provide an improved and inexpensive lid for containers for carbonated beverages and other effervescent beverages in which it is desired to maintain quantities of gases in a dissolved state.

It is a further object of the present invention to provide a lid for beverage cans which enables such cans to be covered tightly without preventing additional cans from being stacked atop a can equipped with such a lid.

It is an important feature of the present invention that it provides a lid including a flexible annular area connecting a convex dome located centrally within the lid to an outer collar portion of the lid, to accommodate changes in pressure within a container equipped with a lid embodying the present invention.

It is another important feature of a beverage can lid embodying the present invention that it includes a circumferential skirt extending downwardly about the periphery of the lid to help seal the lid against the sidewall of a beverage can.

It is a feature of another preferred embodiment of the invention that it has attached to it a tubular opener portion useful for lifting a pull tab or opener lever to assist in opening an easy-opening beverage can.

It is yet a further feature of a preferred embodiment of the present invention that it includes a channel adapted to receive a bottom rim of a beverage container to facilitate stacking of such a container atop a container equipped with a lid according to the present invention.

It is a principal advantage of a beverage container lid according to the present invention that it is better able to accommodate pressure changes within a covered container than has been the case with previously available beverage container lids.

It is another important advantage of a beverage container lid enbodying the present invention that it is less likely than previously available beverage can lids to be dislodged from its intended position atop a beverage container by increased gas pressure within the container.

The foregoing and other objectives, features and advantages of the invention will be more readily understood upon consideration of the following detailed description of the invention, taken in conjunction with the accompanying drawings.

DETAILED DESCRIPTION OF THE INVENTION

Figure 1:
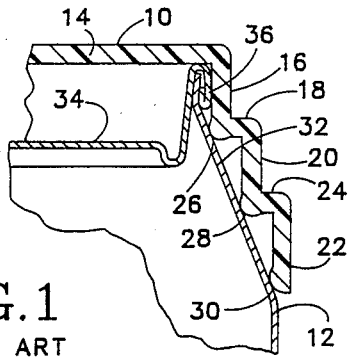
FIG. 1 PRIOR ART
FIG. 1 is a sectional view of one side of the upper portion of a can of the type used commonly for carbonated beverages, equipped with a lid which forms a part of the prior art.

Referring now to the drawings, in FIG. 1 a portion of a prior art plastic can lid 10 is shown in section view, in its usual position attached to an upper portion of a typical aluminum soft drink can 12 of the type commonly used for carbonated beverages. The beverage can lid 10 has a flat, generally planar top portion 14, a depending cylindrical wall 16, an annular area 18 connected to the bottom of the depending cylindrical portion 16, and additional depending cylindrical wall portions 20 and 22 of succeedingly larger diameter, depending from the annular area 18 and interconnected with each other by a similar annular area 24 of an appropriately larger diameter.

Each of the depending cylindrical sidewalls has a continuous small bead 26, 28, or 30 defined at its lowermost margin. The height of each of the cylindrical wall portions 16, 20, and 22, together with the radial width of each of the annular areas 18 and 24, results in the beads 26, 28, and 30 being in contact with the inwardly tapered frusto-conical upper portion 32 of the body of the can 12 so long as the lid 10 is fully depressed. Once pressure within the can 12, communicated outwardly through an opening in the top 34 of the can, is great enough, the lid 10 will be raised, taking the beads 26, 28, and 30 out of contact with the surface of the tapered upper portion 32 of the can 12.

Although the bead 26 may grip the crimped bead 36 by which the top 34 is connected to the upper margin of the sidewall, or body, of the can 12, the ability of the lid 10 to retain the pressure within the can 12 depends on the elasticity of the material of the lid 10 and the proper relationship of the size of the cylindrical wall 16 to the size of the rim 36. As a result, lids of the type of the lid 10 may either be too easily displaced by pressure within the can 12, or be undesirably difficult to remove from the can 12 when it is desired to consume the remainder of any beverage contained within the can 12.

Figure 2:
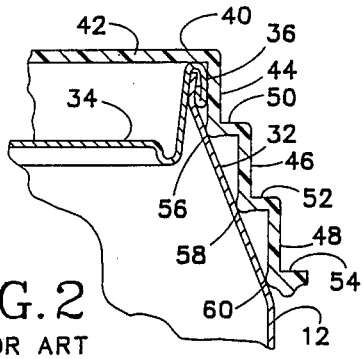
FIG. 2 PRIOR ART
FIG. 2 is a view similar to that of FIG. 1 showing a similar portion of a different lid also forming a part of the prior art.

Referring to FIG. 2, a plastic lid 40 is of generally similar construction to the lid 10. The lid 40, however, is of material of a lesser thickness. The lid 40 includes a generally planar top 42, depending cylindrical walls 44, 46, and 48 and respective radially outwardly extending annular portions 50 and 52, which interconnect the cylindrical wall portions 44, 46, and 48, and a radially outwardly-extending annular portion 54 which stiffens the lower edge of the lid 40 and may be used to assist in removal of the lid 40 from engagement with the top of a can. While beads 56, 58, and 60, respectively, are provided on the inner surface of the lid 40, at the intersection between each cylindrical wall and the associated annular area extending outwardly therefrom, the beads 56, 58, and 60 are not effective enough in retaining the cap 40 atop a carbonated beverage can. In the case of both of the lids 10 and 40, pressure within the soft drink can 12 simply increases without relief as gas comes out of solution in the beverage contained within the can 12, until the lid 10 or 40 is displaced.

Figure 4:
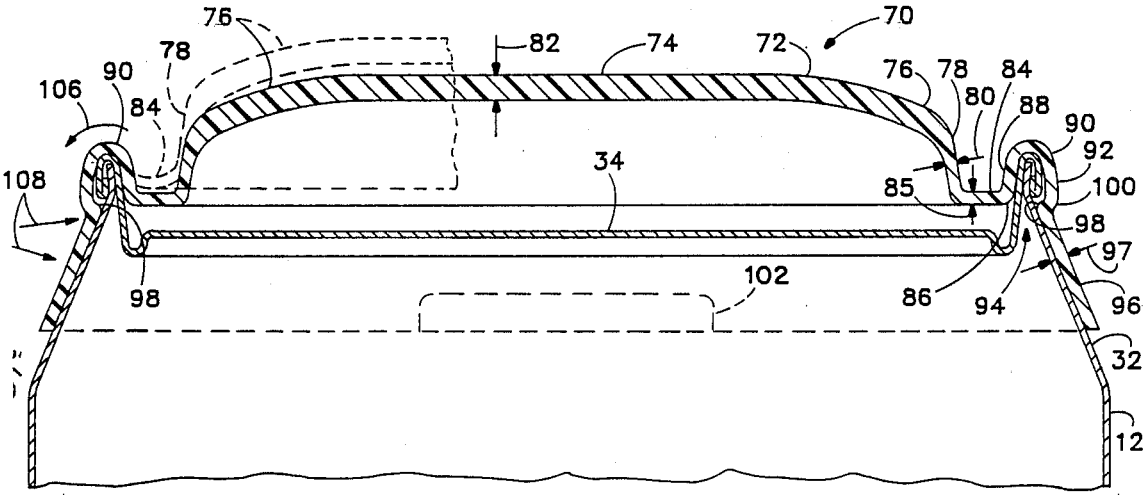
FIG. 4 is a sectional view, taken along the line 4—4, of the beverage container lid of FIG. 3 and an upper portion of a beverage can.
Figure 3:
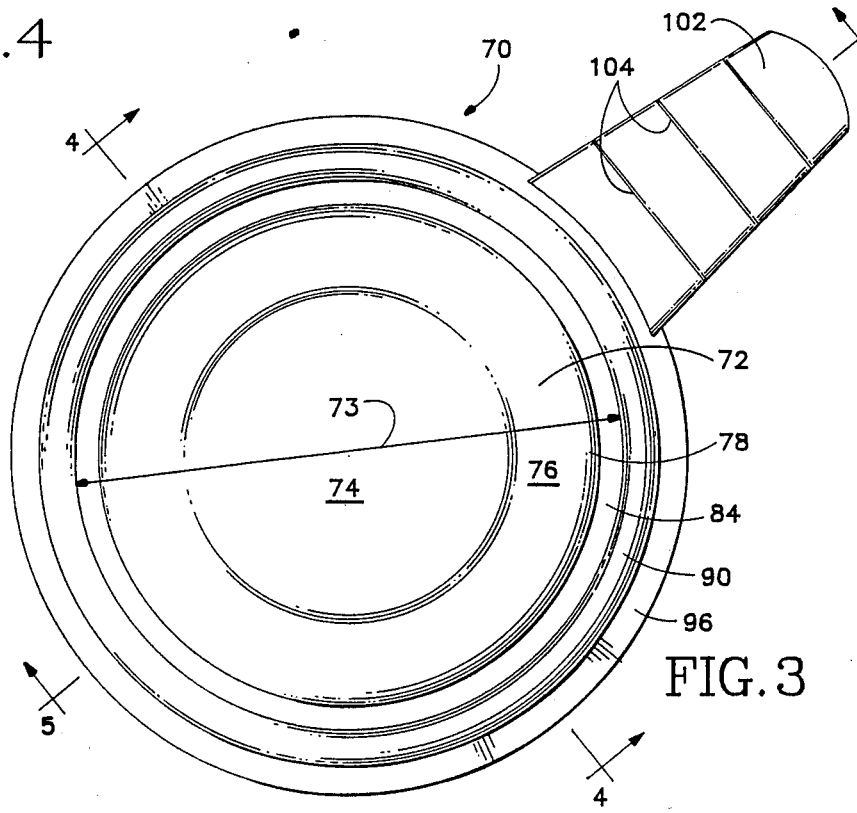
FIG. 3 is a top plan view of a beverage container lid according to the present invention.

Referring next to FIGS. 3 and 4, a beverage can lid 70 embodying the present invention may be of tough, somewhat elastic molded plastic material. It includes a dome 72 having a diameter 73 and a central portion 74 which may be substantially flat. The central portion 74 is surrounded by an annular transition portion 76 which is convex, its shape being smoothly faired into the central portion 74 and a rim portion 78 which has a steep frusto-conical shape. The rim portion 78 has a thickness 80 which is less than the thickness 82 of the central portion 74 and transition portion 76 of the dome 72. Surrounding and connected to the dome 72 is a generally flat annular ring 84, having a thickness 85, which is preferably less than the thickness 80 of the rim 78. The annular ring 84 extends radially outwardly from the bottom of the rim 78 to the bottom 86 of an inner wall 88 of an outer collar 90. The outer collar 90 includes the inner wall 88 and an outer wall 92, which together define a downwardly open groove 94 which is disposed over the bead 36 of a beverage can 12, as shown in FIG. 4, gripping the bead 36 by elastic pressure of the inner wall 88 and outer wall 92 against the inner and outer surfaces of the bead 36.

A frusto-conical skirt 96 extends downward and outwardly beneath the collar 90 with the same slope as the frusto-conically tapered upper portion 32 of the sidewall of the can 12. The skirt 96 fits snugly against the surface of the upper portion 32 of the can 12 to aid in sealing the lid 70 to the can 12. The collar 90 and the skirt 96 have a thickness 97 which may be about equal to, or slightly greater than the thickness 85, but is preferably less than the thickness 82, so that the dome 72 is the least flexible portion of the lid 70.

An upper margin of the skirt 96 defines a lip 98 which is located a slight distance radially inward from the bottom 100 of the outer wall 92 of the collar 90. The lip 98 extends radially inward across a part of the groove 94 and is located close beneath the bottom of the bead 36 which joins the top 34 to the upper margin of the tapered portion 32 of the can 12.

Extending radially outwardly from and attached to the lower portion of the skirt 96 is a horizontally extending handle 102, which may include transversely oriented grip surfaces 104, to be used to remove the lid 70 from atop the can 12.

The lid 70 is installed by pressing it downward atop the can 12, preferably applying pressure on the collar 90 to have the bead 36 extend matingly into the groove 94, and simultaneously applying pressure to the dome 72 before the lid 70 mates sealingly with the can 12, so that the lid 70 is not initially in an upwardly bulged condition merely as a result of installation. When the lid 70 is in place on the can 12, with no significant difference between the pressure inside the can 12 and the surrounding atmospheric pressure, the lid 70 will normally be in the relaxed shape shown in solid line in FIG. 4.

If the gas pressure within the can 12 increases, as a result of agitation of a carbonated beverage, or as a result of gas coming out of solution in the beverage as the beverage warms with the lid 70 in place on the can 12, increased pressure is accommodated by the lid 70 of the present invention. The dome 72 is significantly stiffer than the annular ring 84, because of the greater thickness 82, of the central and transitional parts 74, 76, and the relatively small thicknesses 80 and 85 of the rim 78 and annular ring 84, respectively. The flexibility of the annular ring 84 allows the dome 72 to rise to a greater height above the top 34, to the position shown in broken line in the left hand portion of FIG. 4, when pressure increases beneath the lid 70. This upward displacement of the dome 72 causes the annular ring 84 and the inner wall 88 to flex, urging the collar 90 to roll outward about the bead 36, as indicated by the arrow 106. This deformation of the collar 90, in turn, urges the lip 98 and the upper portion of the skirt 96 more tightly inward against the tapered upper portion 32 of the can 12, as indicated by the arrows 108, so that the lid 70 of the invention tends to grip more tightly around the upper portion 32 of the can 12 as pressure within the interior of the can increases.

Thus, as pressure inside the can 12 covered by the lid 70 increases, the volume contained within the combination of the can 12 and the lid 70 increases, too, so that the pressure does not increase as greatly as would happen in the can 12 under similar conditions except for being covered by one of the prior art lids 10 and 40 described previously. Additionally, the flexing of the lid 70 causes it to grip the tapered upper portion 32 of the can 12 more tightly as pressure increases, so that the lid 70 is more likely than the prior art lids 10 and 40 to remain in place, despite increased pressure being contained by the lid 70. When increased pressure inside the can 12 has caused the dome 72 to rise significantly, it may even be difficult to remove the lid 70 from the can 12 using the handle 102, unless the dome 72 is first momentarily pushed down manually, with enough force to expel a quantity of gas from within.

Figure 5:
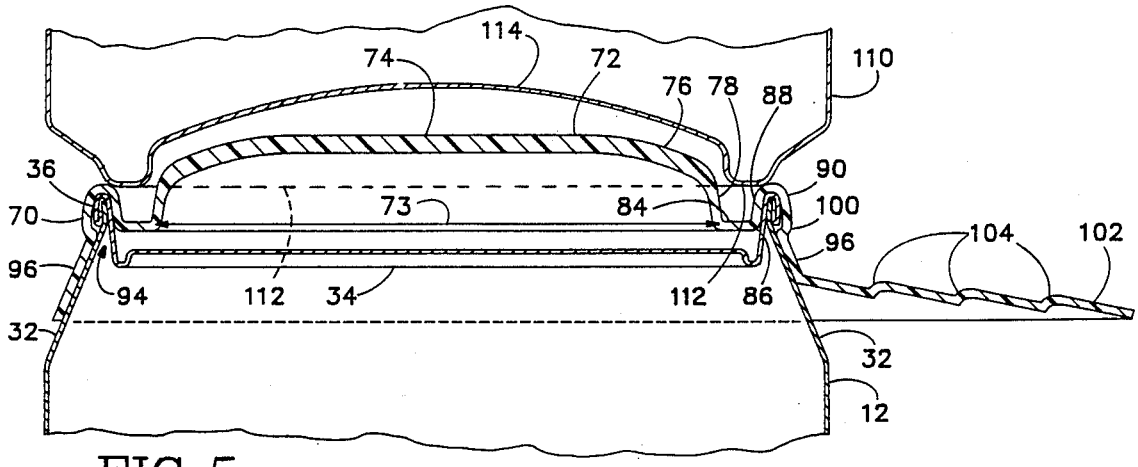
FIG. 5 is a sectional view of a beverage container and the lid of FIGS. 3 and 4, taken along the line 5—5 of FIG. 3, and also showing a lower portion of a similar beverage can stacked atop the lid.
Figure 9:
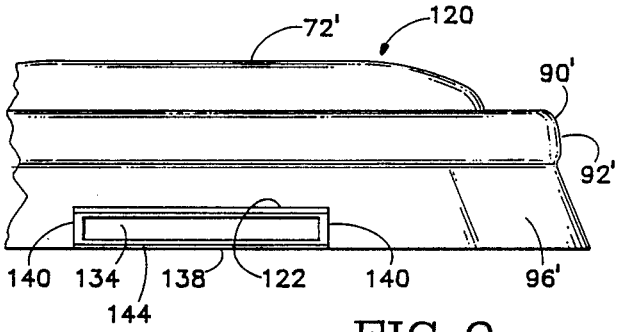
FIG. 9 is a front view of a portion of the can lid shown in FIG. 6, taken along the line 9—9 of FIG. 7.
Figure 8:
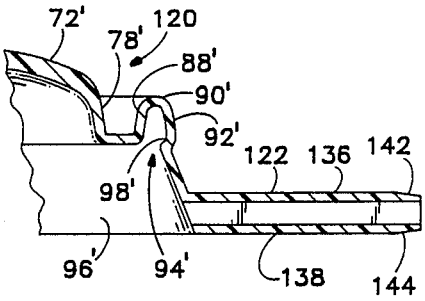
FIG. 8 is a sectional view of the portion of the can lid shown in FIG. 7, taken along line 8—8, at an enlarged scale.
Figure 6:
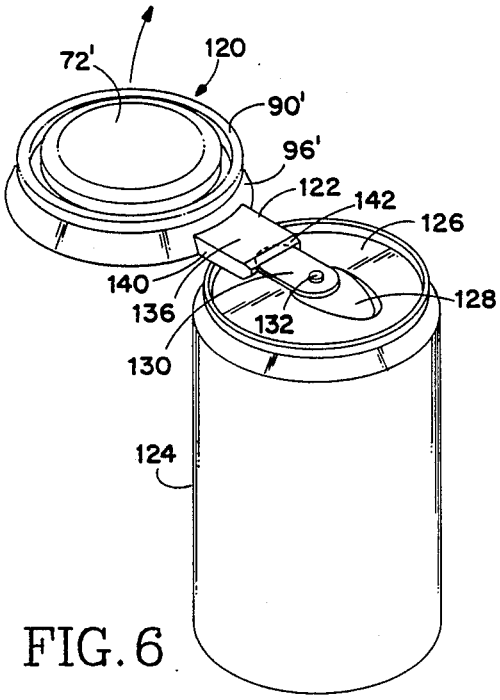
FIG. 6 is a perspective view showing the top of a beverage can together with a lid which is an additional embodiment of the present invention and which includes a device for use in opening so-called easy-open beverage cans.
Figure 7:
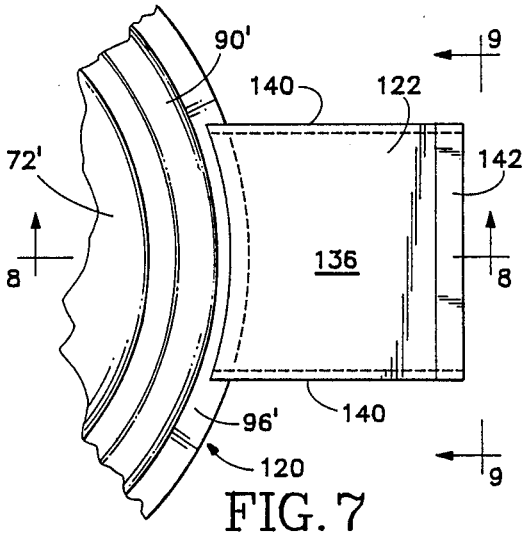
FIG. 7 is a top plan view of a portion of the can lid shown in FIG. 6.

Referring now particularly to FIG. 5, a bottom portion of a can 110 of the same type as the can 12 is shown resting atop the lid 70 which is in place atop the can 12. It will be seen that the can 110 includes a bottom rim 112 and a bottom cavity 114. The diameter 73 of the dome 72 of the lid 70 is small enough to fit into the cavity 114, and the outer collar 90, together with the annular ring 84 and the rim 78 of the dome 72, provide a channel for receiving the bottom rim 112. The can 110 can thus be stacked stably atop the can 12 equipped with the lid 70, in the same manner in which the can 110 could have been stacked atop the can 12 without the lid 70 being present.

A lid 120, shown in FIGS. 6–9, is generally similar to the lid 70 shown in FIGS. 3–5, except that, instead of the handle 102, the lid 120 is equipped with an opener 122 which can be used to assist in opening a beverage can, such as the beverage can 124, which is equipped with an "easy-opening" top 126. The easy-opening top 126 is of sheet metal which has been stamped or otherwise shaped to provide a weakened line defining a portion 128 which can be forced to separate partially from the remainder of the top 126 under the influence of a so-called pull tab or opener lever 130 attached to the top 126, typically by the use of a fastener such as the rivet 132.

The lid 120 is, except for the opener 122, generally similar to the lid 70, and includes a dome 72' having a rim portion 78'. An outer collar 90' includes an inner wall 88' and an outer wall 92', defining a downwardly-open groove 94'. A skirt 96' defines a lip 98' at its upper edge extending into the groove 94'.

The opener 122 extends radially away from the skirt 96' in the form of a relatively wide and low tube defining a slot-like mouth 134, a top 136, a bottom 138, and opposite sides 140. Preferably, the top 136 and bottom 138 include tapered marginal portions 142 and 144, respectively, which leave thin edges of the top 136 and bottom 138 at the mouth 134, to facilitate engaging the opener lever 130 so that it extends into the tubular opening 134. The remainder of the top 136 and bottom 138 are preferably of thicker construction to provide sufficient strength to act as a lever extension to assist in lifting the opener lever 130 in order to break loose the opening portion 128, forcing it downward into the interior of the can 124 in the well-known manner of opening an easy-opening beverage can such as the can 124.

Preferably, the lid 120 is molded of a plastic having sufficient resiliency and elasticity, combined with sufficient stiffness, to sealingly close an opened beverage can yet engage an opening lever such as the opening lever 130 of an easy-opening can top.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A lid for closing the top of a beverage container having an upper portion which is surmounted by a bead protruding radially outwardly and extending circumferentially thereabout, comprising:

(a) a dome;

(b) collar means, surrounding said dome and having respective outer and inner sides thereof defining a downwardly open circumferential groove, for receiving and elastically gripping said bead;

(c) annular ring means of flexible resilient material, for interconnecting said dome movably with said inner side of said collar means and providing for progressive upward movement of said dome relative to said collar means in response to increased pressure within a container closed by said lid;

(d) radially inwardly directed lip means associated with said outer side of said collar means, for elastically gripping said upper portion of said container downwardly adjacent said bead with radially inwardly directed sealing force, wherein said sealing force increases in response to increased upward movement of said dome relative to said collar means;

(e) a frusto-conical skirt of resilient material depending downwardly and outwardly from said collar means; and (f) an opener extending radially outwardly away from said frusto-conical skirt, said opener being tubular and defining mouth means for receiving and manipulating an opener lever of an easy-opening beverage can.

2. A lid for closing the top of a beverage container having an upper portion which is surmounted by a bead protruding radially outwardly and extending circumferentially thereabout, comprising:

(a) a dome;

(b) collar means, surrounding said dome and having respective outer and inner sides thereof defining a downwardly open circumferential groove, for receiving and elastically gripping said bead;

(c) an annular ring of flexible resilient material interconnecting said dome and said inner side of said collar means; and (d) a frusto-conical skirt of resilient material more flexible than the material of said dome, depending downwardly and outwardly from said collar means.

3. The lid of claim 2 wherein said dome includes a circumferential rim and said annular ring circumscribes said rim of said dome and interconnects said rim with said inner side of said collar.

4. The lid of claim 2 wherein said container is a beverage can including a top and a body, wherein said bead is defined by a joint connecting said top to said body and said inner and outer walls of said collar means have respective sizes adapted to fit snugly against radially opposite inner and outer surfaces of said bead to form a seal between said lid and said beverage container.

5. The lid of claim 2, made of a resiliently elastic thermoplastic material.

6. The lid of claim 2 adapted to fit a metal beverage can having a circular bottom defining a downwardly concave bottom surface, wherein said dome has a diameter less than the diameter of said concave bottom surface portion of said beverage can.

7. The lid of claim 2 adapted to fit a metal beverage can having a bottom defining a concave surface surrounded by a bottom rim, wherein said dome is of a size which fits within said concave bottom surface so as to facilitate stacking a similar beverage can atop said beverage can when said lid is in place thereon.

8. The lid of claim 2 wherein said container is a beverage can including a top and a body wherein said inner and outer sides of said collar means cooperatively grip said bead with elastic pressure exerted by both said inner and outer sides.

9. A lid for closing the top of a beverage container having an upper portion which is surmounted by a bead protruding radially outwardly and extending circumferentially thereabout, comprising:

(a) a dome;

(b) collar means, surrounding said dome and having respective outer and inner sides thereof defining a downwardly open circumferential groove, for receiving and elastically gripping said bead;

(c) an annular ring of flexible resilient material interconnecting said dome and said inner side of said collar means;

(d) a frusto-conical skirt of resilient material depending downwardly and outwardly from said collar means; and (e) a handle extending radially outwardly from said skirt.

10. A lid for closing the top of a beverage container having an upper portion which is surmounted by a bead protruding radially outwardly and extending circumferentially thereabout, comprising:

(a) a central portion at least part of which is flexible;

(b) collar means surrounding said central portion, for receiving and elastically gripping said bead;

(c) a frusto-conical skirt of resilient material depending downwardly and outwardly from said collar means; and (d) an opener extending radially outwardly away from said frusto-conical skirt, said opener being tubular and defining mouth means for receiving and manipulating an opener lever if an easy-opening beverage can.

11. The lid of claim 10 wherein said skirt has an upper edge which defines a lip extending inwardly with respect to said outer side of said collar means.

12. The lid of claim 10, including radially inwardly directed lip means, located downwardly adjacent said outer side of said collar means for defining the top of said skirt.

13. The lid of claim 10, including radially inwardly directed lip means for elastically engaging said upper portion of said beverage container beneath said radially protruding bead.

14. The lid of claim 10 wherein said opener includes a top and a bottom, at least one of said top and bottom defining a tapered marginal portion adapted to facilitate engaging an opener lever situated close to the top of an easy-opening beverage can.

15. A lid for closing the top of a beverage container having an upper portion which is surmounted by a bead protruding radially outwardly and extending circumferentially thereabout, comprising:

(a) a dome;

(b) collar means, surrounding said dome and having respective outer and inner sides thereof defining a downwardly open circumferential groove, for receiving and elastically gripping said bead;

(c) an annular ring of flexible resilient material interconnecting said dome and said inner side of said collar means; and (d) handle means, extending radially outward from said collar means, for removing said lid from engagement with a beverage container, said handle means including an opener, said opener being tubular and defining mouth means for receiving and manipulating an opener lever of an easy-opening beverage can.

16. The lid of claim 15 wherein said opener includes a top and a bottom, at least one of said top and bottom defining tapered margin means as a part of said mouth means, for facilitating surrounding engagement of an opener lever situated close to the top of an easy-opening beverage can.

17. A lid for closing the top of a beverage container having an upper portion which is surmounted by a bead protruding radially outwardly and extending circumferentially thereabout, comprising:

(a) a dome;

(b) collar means, surrounding said dome and having respective outer and inner sides thereof defining a downwardly open circumferential groove, for receiving and elastically gripping said bead;

(c) annular ring means of resilient material more flexible than said dome, for interconnecting said dome movably with said inner side of said collar means and providing for progressive upward movement of said dome relative to said collar means in response to increased pressure within a container closed by said lid; and (d) radially inwardly directed lip means associated with said outer side of said collar means, for elastically gripping said upper portion of said container downwardly adjacent said bead with radially inwardly directed sealing force, wherein said sealing force increases in response to increased upward movement of said dome relative to said collar means.

18. A lid for closing the top of a beverage container having an upper portion which is surmounted by a bead protruding radially outwardly and extending circumferentially thereabout, comprising:

(a) a dome;

(b) collar means, surrounding said dome, said collar means being more flexible than said dome and having respective outer and inner sides thereof defining a downwardly open circumferential groove, for receiving and elastically gripping said bead;

(c) annular ring means of flexible resilient material, for interconnecting said dome movably with said inner side of said collar means and providing for progressive upward movement of said dome relative to said collar means in response to increased pressure within a container closed by said lid; and (d) radially inwardly directed lip means associated with said outer side of said collar means, for elastically gripping said upper portion of said container downwardly adjacent said bead with radially inwardly directed sealing force, wherein said sealing force increases in response to increased upward movement of said dome relative to said collar means.

19. A lid for closing the top of a beverage container having an upper portion which is surmounted by a bead protruding radially outwardly and extending circumferentially thereabout, comprising:

(a) a dome;

(b) collar means, surrounding said dome and having respective outer and inner sides thereof defining a downwardly open circumferential groove, for receiving and elastically gripping said bead;

(c) annular ring means of flexible resilient material, for interconnecting said dome movably with said inner side of said collar means and providing for progressive upward movement of said dome relative to said collar means in response to increased pressure within a container closed by said lid;

(d) radially inwardly directed lip means associated with said outer side of said collar means, for elastically gripping said upper portion of said container downwardly adjacent said bead with radially inwardly directed sealing force, wherein said sealing force increases in response to increased upward movement of said dome relative to said collar means; and (e) a frusto-conical skirt of resilient material more flexible than said dome, depending downwardly and outwardly from said collar means.

20. A lid for closing the top of a beverage container having an upper portion which is surmounted by a bead protruding radially outwardly and extending circumferentially thereabout, comprising:

(a) a dome;

(b) collar means, surrounding said dome and having respective outer and inner sides thereof defining a downwardly open circumferential groove, for receiving and elastically gripping said bead;

(c) annular ring means of flexible resilient material, for interconnecting said dome movably with said inner side of said collar means in response to increased pressure within a container closed by said lid;

(d) radially inwardly directed lip means associated with said outer side of said collar means, for elastically gripping said upper portion of said container downwardly adjacent said bead with radially inwardly directed sealing force, wherein said sealing force increases in response to increased upward movement of said dome relative to said collar means;

(e) a frusto-conical skirt of resilient material depending downwardly and outwardly from said collar means; and (f) a handle extending radially outwardly from said skirt.

* * * * *